United States Patent [19]

Sykes

[11] Patent Number: 4,574,985

[45] Date of Patent: Mar. 11, 1986

[54] DISPENSING VALVE INCLUDING AN ELASTOMERIC SEAL DISPOSED BETWEEN PLASTIC PLUG AND VALVE SEAT MEMBERS

[75] Inventor: Donald J. Sykes, Upper Saddle River, N.J.

[73] Assignee: Marpac Industries, Inc., Waldwick, N.J.

[21] Appl. No.: 588,195

[22] Filed: Mar. 12, 1984

[51] Int. Cl.[4] ..... B65D 47/06

[52] U.S. Cl. ..... 222/83.5; 222/501

[58] Field of Search ..... 222/83, 83.5, 518, 88, 222/89, 91, 501; 251/322, 323

[56] References Cited

U.S. PATENT DOCUMENTS

| | | | |
|---|---|---|---|
| 3,158,351 | 11/1964 | Kauffman et al. | 251/322 |
| 4,372,467 | 2/1983 | Pritchitt | 222/501 |
| 4,378,077 | 3/1983 | Akino | 222/501 X |

*Primary Examiner*—Stanley H. Tollberg

*Attorney, Agent, or Firm*—W. Patrick Quast

[57] ABSTRACT

A dispensing valve for use on a supply bottle containing fluid for a copier or printer, including an outer unit having a bottle cap with a central spider with slots and having an inner sleeve projecting into the bottle forming a valve seat, and including an inner unit having an elastomer member and having a spring-biased seal plug urging the elastomer member against the valve seat, said plug being adapted to rotate slightly to fit the elastomer member to the valve seat and said plug having a high strength, chisel-like tip for breaking a secondary seal in the bottle.

10 Claims, 2 Drawing Figures

DISPENSING VALVE INCLUDING AN ELASTOMERIC SEAL DISPOSED BETWEEN PLASTIC PLUG AND VALVE SEAT MEMBERS

BACKGROUND OF THE INVENTION

The invention relates to a dispensing valve for a bottle containing fluid. The invention particularly relates to a dispensing valve for a bottle containing fluid having an easily replaceable valve seal, elastomer member and having a spindle for piercing the bottle secondary seal membrane.

A prior art dispensing valve is shown in U.S. Pat. No. 4,372,467 in FIG. 2 thereof. The prior art valve includes a valve seal, or valve plug of rubber-like material for engaging the seat, a spindle for supporting the plug for movement of the plug relative to the seat, and a compression spring for urging the plug into contact with the valve seat.

A problem with the prior art valve is that it is necessary to replace the spindle and plug subassembly or the completed valve when the plug or elastomer bushing loses its compliance or becomes dirty. Another problem with the prior art valve is that some applications have a bottle with a secondary seal that is broken open by the spindle and/or the plug, and this sometimes damages the plug or bushing.

An object of the invention is to provide a dispensing valve that has an easily replaceable seal portion. Another object is to provide a spindle and plug assembly, which can break open the secondary seal without damaging the plug or bushing. Another object is to use a relatively soft seal material, and to use a relatively hard spindle material, and to use a plug material hard enough for breaking open the secondary seal but compliant enough to prevent overcompression of the elastomer seal

SUMMARY OF THE INVENTION

According to the present invention, a dispensing valve is provided. The valve comprises a threaded cap having a valve seat with an axis, and a spindle and plug assembly coaxial therewith and axially movable relative thereto, wherein the spindle and plug assembly comprises an elongate spindle member having a pointed end portion, a plug fixedly connected to said spindle member and disposed adjacent said pointed end portion, an elastomer member of rubberlike material disposed between said valve seat and said plug, a compression spring for urging the plug against said elastomer member and said valve seat.

By using the spindle and plug assembly of the invention, it overcomes the problem of replacing the sealing member, and it overcomes the problem of breaking open the secondary seal in the bottle without damaging the sealing member.

The above advantages and subsequent description will be more readily understood by reference to the following drawings.

BRIEF DISCUSSION OF THE DRAWINGS

FIG. 1 is a vertical section view through the axis of the dispensing valve according to the invention; and FIG. 2 is a vertical section view through the axis of another embodiment of the dispensing valve according to the invention.

DETAILED DESCRIPTION OF THE INVENTION

Figure 1:
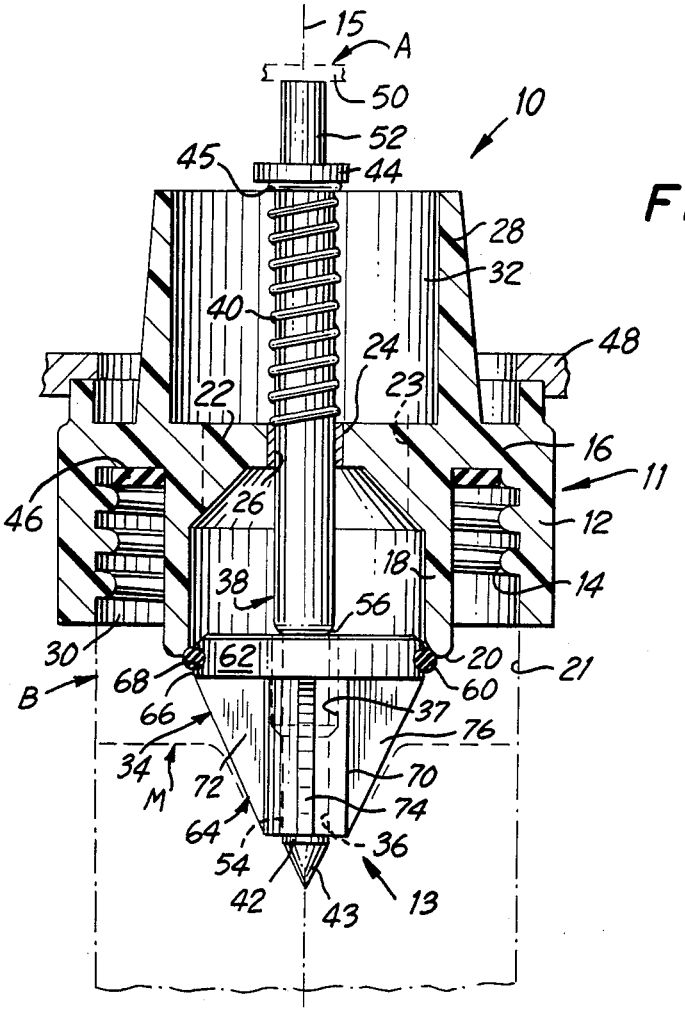

In FIG. 1, a preferred embodiment of dispensing valve 10 according to the invention is provided. Valve 10 includes an outer unit subassembly 11, and an inner unit subassembly 13.

Outer unit 11, which has an axis 15 is disposed radially outwardly from inner unit 13. Outer unit 11 has a cap 12, which has an inner thread 14. Outer unit 11 also has a mid-flange 16, and a sleeve 18, which has a valve seat 20. Inner thread 14 is threaded over an outer thread (not shown) of an opening 21 of bottle B.

Inner unit 13 moves relative to outer unit 11, from a closed position, as shown in FIG. 1, to an open position, when actuated by an actuator A. The actuator A is described in the aforementioned prior art U.S. Pat. No. 4,372,467.

Bottle B is positioned as shown, or in an inverted position. Valve 10 supports bottle B, and valve 10 is supported by an annular support member 48, which is a member as shown in FIG. 1 of the aforementioned prior art U.S. Pat. No. 4,372,467, and which is more fully described hereafter.

Outer unit 11 also includes a spider portion 22, which has slotted openings 23 for allowing fluid from bottle B to pass therethrough when Bottle B is inverted. Spider 22 has a hub 24 which has a central bore 26. Bore 26 guides inner unit 13 in its reciprocal axial movement relative to outer unit 11.

Outer unit 11, which is composed of plastic material, also has a second sleeve 28, which extends in an axially outward direction from mid-flange 16.

Cap 14 and sleeve 18, which are cylindrical, form an annular well 30 therebetween. Sleeve 28, which is also cylindrical, encloses an axially outer, annular well 32.

When inner unit 13 is open, fluid can pass from well 30 and from bottle B, through spider 22, to well 32. The plurality of radial slots 23 permit passage of fluid through spider 22. Hub 24 is preferably press-fitted into spider 22 coaxially therewith, so that hub 24 is fixedly connected to spider 22. Hub 24 is made of a lower friction material than the plastic material of spider 28.

Inner unit 13 includes a valve plug 34, which has a central axial bore 36, that receives a steel or plastic spindle 38. Bore 36 also has an enlarged bore portion 37.

Spindle 38, which is journaled in spider bore 26 has a compression spring 40, which bears against hub 24 at its axially inner end. Spindle 38 also has a cylindrical end portion 42, and a pointed tip portion 43, which, together with plug 34, are used to break open membrane M.

Spindle 38 also has a retainer ring 44 with a washer 45, which retains the axially outer end of spring 40. A sealing gasket 46 for cap 12 and bottle B is also provided.

Valve plug 34, which is composed of a selected plastic material, is preferably molded over spindle 38. Plug 34 can also be press-fitted onto spindle 38, if end portion 42 and the tip 43 are made with smaller outside diameters than the inside diameter of bore 36, for an alternate design.

Enlarged bore portion 37 permits a slight rotation of plug 34 relative to end portion 42, so that plug 34 can better position itself within valve seat 20 when plug 34 is in the closed position.

If bottle B and valve 10 are used in an inverted position, such as the application shown in prior art U.S. Pat. No. 4,372,467 then actuator A has a wall 50 for such application; which is also a sump wall; amd valve 10 has a support wall 48. Spindle 38 also has a reduced section 52, which is adjacent to wall 50 and which supports ring 44.

Plug 34 includes an elastomer sealing member 60, a conical section 62, which urges elastomer sealing member 60 against valve seat 20, and a rib section 64, which is adapted for tearing membrane M after membrane M is pierced by end portion 42 and tip portion 43.

Conical section 62 has a conical surface 66, which has an annular groove 68, that receives elastomer sealing member 60.

Rib section 64 includes a central cylindrical portion 70, which is coaxial with bore 36 and spindle 38 along axis 15, and includes four chisel ribs 72, 74, 76, 78 for tearing membrane M. Ribs 72, 74, 76, 78 also act as abutments under conical section 62 for applying pressure to elastomer sealing member 60 in the closed position. Rib 78, which is not shown in FIG. 1, is disposed diametrically opposite to rib 74. In FIG. 1, plug 34 only is shown in an elevation view.

Elastomer sealing member 60 is composed of rubber, or rubber-like material. Plug sections 62 and 64 are a molded plastic material. Outer unit 12 is a plastic material. Spindle 38 and spring 40 are a plastic material. Hub 24 is a low-friction, high strength material. For plug sections 62 and 64 plastic material is chosen for high strength and hardness for suitability for breaking and tearing membrane M and for compliance for compliant support of elastomer sealing member 60.

Figure 2:
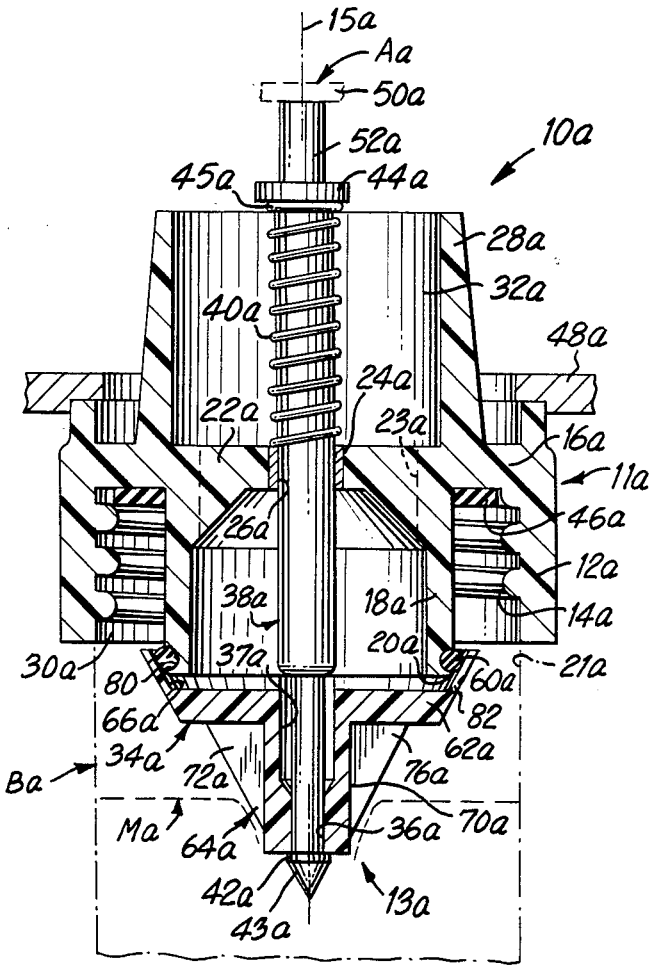

In FIG. 2, an alternate embodiment of valve 10 is shown. Parts of FIG. 2, which are identical to parts of FIG. 1, have the same numerals with a subscript "a" added thereto.

Valve 10*a* includes outer unit 11*a* and inner unit 13*a*. Outer unit 11*a* has an axis 15*a* and includes a cap 12*a* with an inner thread 14*a*. Outer unit 11*a* also has a flange 16*a* and an axial inner sleeve 18*a* with a valve seat 20*a*. Inner thread 14*a* is threaded over an outer thread (not shown) of an opening 21*a* on bottle Ba. Inner unit 13*a* is actuated by actuator Aa.

Outer unit 11*a* includes a spider 22*a* which has slotted openings 23*a*. Spider 22*a* has a hub 24*a*, which has a central bore 26*a*. Outer unit 11*a*, which is plastic, has an axial outer sleeve 28*a*. Cap 12*a* and sleeve 18*a* form a well 30*a*. Sleeve 28*a* also encloses a well 32*a*.

Inner unit 13*a* includes a valve plug 34*a*, which has a bore 36*a*, that receives a spindle 38*a*. Bore 36*a* also has an enlarged bore portion 37*a*. Spindle 38*a* has a spring 40*a*, which bears against hub 24*a*, and has an end portion 42*a* with a pointed tip 43*a*. Spindle 38*a* also has a retainer ring 44*a* and washer 45*a*. Cap 12*a* has a sealing gasket 46*a*. Valve 10*a* has a support member 48*a*. Actuator Aa has a wall 50*a*, which is adjacent a spindle reduced section 52*a*.

Plug 34*a*, which is shown in a section view in FIG. 2, includes an elastomer sealing member 60*a*, a conical section 62*a* and a rib section 64*a*. Conical section 62*a* has a conical surface 66*a*, which bears against elastomer sealing member 60*a*. Rib section 64*a* includes a cylindrical portion 70*a*, and includes four ribs 72*a*, 74*a*, 76*a*, 78*a*. Ribs 74*a* and 78*a* are not shown in FIG. 2, but are spaced ninety degrees from respective ribs 72*a* and 76*a*.

Valve seat 20*a* has an annular groove 80 for receiving elastomer sealing member, 60*a*. Conical section 62*a* has a relatively thin flange portion 82 pressing against elastomer sealing member 60*a*. Portion 82 allows more compliance in its parts, which bear against elastomer sealing member 60*a*, in order to prevent local overcompression of the elastomer sealing member 60*a*.

The advantages of valve 10, and also valve 10*a*, are described hereafter.

First, a dispensing valve is provided, which has an easily replaceable elastomer sealing member.

Second, a dispensing valve is provided, which can easily break open the secondary seal membrane of a bottle.

Third, a valve is provided, which does not damage its seal plug when the plug is breaking open the secondary seal membrane of a bottle.

Fourth, a valve is provided in one embodiment, wherein the seal plug has a separate elastomer sealing member and has a conical section with a groove which can easily hold the elastomer sealing member, during axial reciprocal movement of the spindle.

Fifth, a valve is provided, wherein the plug conical section is urged against the elastomer sealing member.

Sixth, a valve is provided, in one embodiment, wherein the plug conical section is relatively compliant after the elastomer sealing member is compressed so that the elastomer sealing member is not overcompressed.

Seventh, a valve is provided, wherein the spindle end section and pointed tip easily rupture and tear the secondary seal membrane without damaging the spindle end section.

Eight, a valve is provided, wherein the plug conical section is provided with a non-abrasive surface which is in contact with the relatively soft rubber elastomer sealing member thereby preventing surface wear of the elastomer sealing member.

Ninth, the elastomer sealing member of the valve is easily replaced allowing continual reuse of the spindle and plug.

Although the invention is described in two embodiments, the scope of the invention is only limited by the following claims.

Although the invention refers particularly to application for fluids, it is to be understood that it can be utilized in dry powder applications such as with products containing toner for plain paper copiers.

What is claimed is:

1. A dispensing valve for use on a supply bottle having an opening and containing fluid for a copier or printer, said valve having an axis and including a radially outer unit, a radially inner unit, and seal effecting means, said outer unit including:

a cap for coupling the bottle at the opening thereof, said cap having a radially inner central spider portion with slots for passage of fluid therethrough and having a central bore for guiding the inner unit;

an axially outer sleeve mounted on the cap and coaxial with the spider, and enclosing an outer well for the fluid; and an axially inner sleeve mounted on the cap and coaxial with the spider and having a coaxial valve seat disposed inside the bottle and adapted to engage the inner unit for sealing in the fluid; and said inner unit includes:

a spindle journaled in the spider bore coaxial therewith;

a compliant plastic valve plug mounted on the spindle, coaxial therewith; and a compression spring mounted on the spindle coaxial therewith for urging the plug against the valve seat;

said plug comprising:

a plug conical section having a conical surface, and a rib section having a cylindrical portion fixedly connected to the spindle and having a plurality of peripherally spaced ribs for supporting the conical section and for use in rupturing a membrane inside the bottle, said seal effecting means including:

annular groove means coaxial with said spindle and disposed between said valve seat and said conical surface;

an elastomer member composed of rubber-like material, disposed in said annular groove means, whereby when said compression spring urges said plug against the valve seat said elastomer member is compressed in said annular groove means thereby effecting a seal, said annular groove means is disposed on a radially outer surface of said valve seat, and wherein said plug conical surface faces in a radially inward direction for engaging said elastomer member and for applying an axial force on said elastomer member for sealing and for applying a radial force on said elastomer member for preventing movement of said elastomer member out from said groove.

2. The valve of claim 1, wherein said spindle has an axially inner end portion having a pointed tip, said tip extending axially outwardly from said plug, for piercing a membrane in the bottle, and for supporting the plug against axial movement relative to the spindle.

3. The valve of claim 2, wherein said plug has a central bore fixedly connected to said spindle, said bore having an enlarged portion disposed adjacent to said plug conical section, for slight angular displacement of said plug about its rib section for ease of positioning of the conical surface and elastomer member within the valve seat.

4. The valve of claim 2, wherein said plug rib section has an elongate tapered shape having a profile aligned between said pointed tip and said plug conical section for tearing the membrane in the bottle and for supporting the conical section while allowing slight tilting of the conical section about the rib section.

5. The valve of claim 4, wherein said plug rib section has an X-shaped cross section for ease of tearing the membrane in four segments.

6. A dispensing valve for use on a supply bottle having an opening and containing fluid for a copier or printer, said valve having an axis and including a radially outer unit, a radially inner unit, and seal effecting means, said outer unit including:

a cap for coupling the bottle at the opening thereof, said cap having a radially inner central spider portion with slots for passage of fluid therethrough and having a central bore for guiding the inner unit;

an axially outer sleeve mounted on the cap and coaxial with the spider, and enclosing an outer well for the fluid; and an axially inner sleeve mounted on the cap and coaxial with the spider and having a coaxial valve seat disposed inside the bottle and adapted to engage the inner unit for sealing in the fluid; and said inner unit includes:

a spindle journaled in the spider bore coaxial therewith;

a compliant plastic valve plug mounted on the spindle, coaxial therewith; and a compression spring mounted on the spindle coaxial therewith for urging the plug against the valve seat;

said plug comprising:

a plug conical section having a conical surface, and a rib section having a cylindrical portion fixedly connected to the spindle and having a plurality of peripherally spaced ribs for supporting the conical section and for use in rupturing a membrane inside the bottle, said seal effecting means including:

annular groove means coaxial with said spindle and disposed between said valve seat and said conical surface;

an elastomer member composed of rubber-like material, disposed in said annular groove means, whereby when said compression spring urges said plug against the valve seat said elastomer member is compressed in said annular groove means thereby effecting a seal, said annular groove means is disposed in the radially outer conical surface of said plug conical section, and wherein said plug conical surface faces in a radially outward direction for engaging said elastomer member and for applying an axial force on said elastomer member for sealing and for applying a radial force on said elastomer member for preventing movement of said elastomer member out from said groove.

7. The valve of claim 6, wherein said spindle has an axially inner end portion having a pointed tip, said tip extending axially outwardly from said plug, for piercing a membrane in the bottle, and for supporting the plug against axial movement relative to the spindle.

8. The valve of claim 7, wherein said plug has a central bore fixedly connected to said spindle, said bore having an enlarged portion disposed adjacent to said plug conical section, for slight angular displacement of said plug about its rib section for ease of positioning of the conical surface and elastomer member within the valve seat.

9. The valve of claim 7, wherein said plug rib section has an elongate tapered shaped having a profile aligned between said pointed tip and said plug conical section for tearing the membrane in the bottle and for supporting the conical section while allowing slight tilting of the conical section about the rib section.

10. The valve of claim 9, wherein said plug rib section has an X-shaped cross section for ease of tearing the membrane in four segments.

* * * * *